US012241034B2

(12) United States Patent
Dhawan et al.

(10) Patent No.: US 12,241,034 B2
(45) Date of Patent: Mar. 4, 2025

(54) SYNTHETIC LUBRICITY ADDITIVES FOR HYDROCARBON FUELS

(71) Applicant: Ecolab USA Inc., St. Paul, MN (US)

(72) Inventors: Ashish Dhawan, Aurora, IL (US); Nestor U. Soriano, Jr., Missouri City, TX (US); Karina Eureste, Houston, TX (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 18/243,984

(22) Filed: Sep. 8, 2023

(65) Prior Publication Data

US 2024/0117264 A1 Apr. 11, 2024

Related U.S. Application Data

(60) Provisional application No. 63/405,303, filed on Sep. 9, 2022.

(51) Int. Cl.
*C10L 10/08* (2006.01)
*C10L 1/222* (2006.01)

(52) U.S. Cl.
CPC ..... *C10L 10/08* (2013.01); *C10L 1/2225* (2013.01); *C10L 2270/026* (2013.01)

(58) Field of Classification Search
CPC ..... C10L 1/221; C10L 1/2225; C10L 10/08; C10L 2200/0446; C10L 2270/026
See application file for complete search history.

(56) References Cited

U.S. PATENT DOCUMENTS 4,259,086 A 3/1981 Machleder et al.
4,295,860 A * 10/1981 Childs ..... C10L 1/2225 252/392
4,904,404 A 2/1990 Liu et al.
5,068,046 A * 11/1991 Blain ..... C10M 133/08 508/559
5,085,788 A 2/1992 Emert et al.
5,328,622 A 7/1994 Emeri et al.
5,670,464 A 9/1997 Kita et al.
6,525,221 B1 * 2/2003 Youn ..... C10L 1/2225 564/434
9,340,742 B1 5/2016 Fang et al.
9,388,361 B2 7/2016 Terada et al.
9,677,023 B2 6/2017 DeSantis et al.
10,899,985 B2 1/2021 Smith et al.
11,130,923 B2 9/2021 Hansch et al.
11,236,040 B2 2/2022 Dhawan et al.
11,359,291 B2 6/2022 Dhawan et al.
2003/0092585 A1 5/2003 O'Connor et al.
2008/0016753 A1 * 1/2008 Siggelkow ..... C10L 10/14 525/143
2017/0096611 A1 4/2017 Stevenson et al.
2017/0107441 A1 4/2017 Adams et al.
2022/0204889 A1 6/2022 Dhawan et al.

FOREIGN PATENT DOCUMENTS

CA 2209497 C * 10/2006 ..... C10L 1/2225

OTHER PUBLICATIONS

Wang et al. (2021) "The effect of tetrethylenepentamine (TEPA) on the oxidation stability and the lubrication performance of biodiesel", Industrial Crops & Products, 171:1-11.

* cited by examiner

*Primary Examiner* — Ellen M Mcavoy
*Assistant Examiner* — Chantel Graham
(74) *Attorney, Agent, or Firm* — Kagan Binder, PLLC

(57) ABSTRACT

Lubricity additives for fuels compositions are provided which are hydrocarbyl-containing oxygenated polyamines according to Formula I:

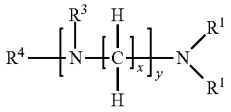

wherein one or more of —$R^1$, —$R^2$, —$R^3$, and —$R^4$ is a carbon- and oxygen-containing group including a hydrophobic hydrocarbyl portion.

20 Claims, No Drawings

SYNTHETIC LUBRICITY ADDITIVES FOR HYDROCARBON FUELS

CROSS REFERENCE TO RELATED APPLICATION

This application claims the benefit of U.S. Provisional Patent Application Ser. No. 63/405,303, filed Sep. 9, 2022, the disclosure of which is incorporated by reference herein in its entirety.

FIELD OF THE DISCLOSURE

This disclosure relates to lubricity additives for hydrocarbon fuels, including a hydrocarbyl-containing oxygenated polyamine compound, such as formed by the reaction of a polyamine with a hydrocarbyl-containing epoxide compound.

BACKGROUND OF THE DISCLOSURE

Combustion of diesel fuel can result in the release of particulates that include nitrates and sulphates, which are a source of air pollution. To address this type of environmental pollution, oil refiners process fuels to remove materials that cause pollution upon combustion. Processing methods provide ultra-low sulfur diesel (ULSD) fuel, which has been used for over 15 years in the United States, and have substantially reduced levels of sulfur thereby controlling and minimizing levels of particulate matter in air resulting from diesel fuel combustion.

A common process to reduce sulfur levels is by hydrotreating or hydrodesulfurization (HDS) which is a catalytic chemical process typically using a alumina base with cobalt and molybdenum that removes sulfur (S) from refined petroleum products. However, this type of process also removes compounds such as trace oxygen and nitrogen compounds that naturally enhance the lubricity of the fuel. Having diesel fuel with good lubricity is important as it reduces wear of engine components like bearings, pistons, cylinder liners, and the valve train. Fuel lubricity can also facilitate piston cooling, prevent corrosion due to acids and moisture, promote piston cleaning and preventing sludge build-up, and can keeping seals lubricated and control swelling.

Therefore, to address these issues, lubricity additives are typically added to ULSD prior to use so that the treated fuel has reduced friction and in turn reduces the risk of engine failure or break-down. Many current commercial lubricity additives include are based on natural materials, such as fatty acids derived from vegetable oils or plant oils. However, variabilities in qualities and properties of vegetable and plant-based oils in various regions create product quality inconsistencies, which in turn can cause variations in the level of lubricity such materials can provide to treated ULSD. As such, these types of lubricity additives are subjected to supply and cost constraints due to the inherent price volatility of these raw materials. Alternatives to these natural material-based lubricity additives have been problematic because of high costs and inferior performance.

SUMMARY

The present disclosure provides lubricity compounds, additive compositions including the lubricity compounds, methods for improving lubricity in a fuel composition, as well as fuel compositions that include the lubricity compounds. In exemplary embodiments, the lubricity compounds can be used in diesel fuels, lubricity additive compositions, and in methods for improving the lubricity of a diesel fuel, such as ultra-low sulfur diesel (ULSD). The lubricity compounds are hydrocarbyl-containing oxygenated polyamines, which have a polyamine core and include one or more chemical groups which include an oxygen atom and a carbon-containing hydrophobic group.

In one aspect, the disclosure provides a method for improving the lubricity of a fuel composition, which includes a step of adding a composition comprising a hydrocarbyl-containing oxygenated polyamine that is a compound of Formula I:

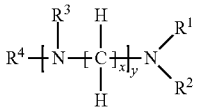

to a fuel composition. In Formula I, —$R^1$, —$R^2$, —$R^3$, and —$R^4$, are independently selected from —H, —OH, alkyl, aryl, alkyl aryl, and aryl alkyl, which can be optionally substituted, —$(CH_2)_xNR^5R^6$, and a carbon- and oxygen-containing group including one or more oxygen atoms in the form of (i) a hydroxyl group, (ii) an ether group, or both (i) and (ii). In compounds of Formula I, at least one of $R^1$-$R^4$ is the carbon- and oxygen-containing group. Also, in Formula I, x is an integer in the range of 1-4, y is an integer in the range of 1-11, 1-10 or 1-9, and $R^5$ and $R^6$ have the same meaning as $R^1$-$R^4$. In Formula I, the compound can have a number of carbon atoms that is three times or greater than a number of nitrogen atoms in the compound.

In the compound of Formula I, the one or more carbon- and oxygen-containing group(s) can include a number of carbon atoms in the range of 6-30, 8-24, 10-22, or 12-20. one or more carbon- and oxygen-containing group(s) can include C6-C30, or C10-C22 linear, branched, cyclic alkyl, aryl, alkyl-aryl, or aryl-alkyl. The one or more carbon- and oxygen-containing group(s) can have optional substitution, such as halo groups, like chloro and fluoro; mercapto, and alkylmercapto, and also groups that include a non-oxygen heteroatom, such as nitro, nitroso, and sulfoxy.

In more specific aspect of the disclosure, the hydrocarbyl-containing oxygenated polyamine is a compound of Formula II:

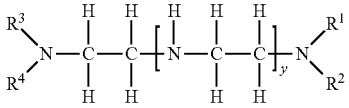

wherein $R^1$-$R^4$ are independently selected from —H, —OH, alkyl, aryl, alkyl aryl, aryl alkyl, and the carbon- and oxygen-containing group, wherein y is an integer in the range of 1-8, and wherein at least one of $R^1$-$R^4$ is the carbon- and oxygen-containing group.

In aspects of the disclosure, the compound of Formula I has an acid value of less than about 1.5, less than about 1.25, less than about 1, or less than about 0.75.

Accordingly, the disclosure also provides fuel compositions, such as diesel fuel compositions comprising the compound of Formula I as described herein.

In other aspects, the disclosure provides a method for making a hydrocarbyl-containing oxygenated polyamine fuel lubricity additive. The method includes a step of reacting a polyamine of Formula III:

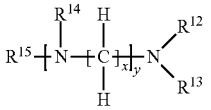

wherein —$R^{12}$, —$R^{13}$, —$R^{14}$, and —$R^{15}$, are independently selected from —H, —OH, alkyl, aryl, alkyl aryl, and aryl alkyl, which can be optionally substituted, wherein at least one of $R^{12}$-$R^{15}$ is —H, wherein x is an integer in the range of 1-4, wherein y is an integer in the range of 1-11, 1-10 or 1-9, with an epoxide-containing compound having a number of carbons in the range of 6-30, 8-24, 10-22, or 12-20, to provide the oxygenated polyamine. In aspects, the epoxide-containing compound has a single epoxide group, or the epoxide-containing compound is a glycidyl ether compound.

In aspects, the disclosure also provides a lubricity additive composition including the compound of Formula I, or a compound prepared according to the method as described herein, and a fuel-compatible diluent.

In aspects of the disclosure, the compound of Formula I is present in a fuel composition, such as a diesel fuel composition, at a concentration in the range of about 30 ppm to about 1000 ppm, about 50 ppm to about 500 ppm, or about 75 ppm to about 300 ppm.

In another aspect, the present disclosure provides fuel mixtures comprising a hydrocarbon fuel; and a lubricity additive according to the present disclosure. In various embodiments the hydrocarbon fuel may be a middle distillate fuel, derived from petroleum or biobased feedstock. Additional embodiments of the fuel mixtures of the present disclosure are described below.

In another aspect, the disclosure provides compounds of Formula I, for example, configured for use as a lubricity enhancer.

Hydrocarbyl-containing oxygenated polyamine fuel lubricity additives were readily synthesized and showed very good ability to provide levels of lubrication comparable to commercial lubricants based on natural compounds that are used as industry standards. Moreover, the hydrocarbyl-containing oxygenated polyamine fuel lubricity additives provide various advantages over these natural lubricity additives as they are synthetic, which allows tighter control over product specifications, which is desirable from a manufacturing standpoint.

Compounds of Formulas I and II of the disclosure have a desired balance of polarity and hydrophobicity; in particular, the compounds have sufficient polarity to associate with a substrate surface which is the target for reduced friction, and sufficient hydrophobicity to provide good lubricity. The target substrate surface may be, for example, a metal-containing surface of an engine part. The number, combination, and arrangement of nitrogen and oxygen atoms of the compounds of the disclosure provides sites for metal attachment.

In addition, hydrocarbyl-containing oxygenated polyamine fuel lubricity additives of the disclosure also exhibit very low acid number values, which is another desirable feature of a lubricity additive. It is beneficial to have a low acid number in a fuel composition such as diesel because it reduces the likelihood of additive breakdown, and therefore fuel formulations with additives, including those lubricity additives of the disclosure, can maintain desirable properties over longer periods of storage and use.

DETAILED DESCRIPTION

Additional embodiments of the compounds, compositions, methods of the present disclosure are described below. The preceding summary of the present disclosure is not intended to describe each embodiment of the present invention. The details of one or more embodiments of the invention are also set forth in the description below. Other features, objects, and advantages of the invention will be apparent from the description and from the claims.

In particular, hydrocarbyl-containing oxygenated polyamines are described, such as those of Formula I and Formula II, which have a polyamine core and include one or more chemical groups which include an oxygen atom and carbon-containing hydrophobic group.

The hydrocarbyl-containing oxygenated polyamines can be used as lubricity compounds, can be present in additive compositions, and can be used in methods for improving lubricity in a fuel composition. In particular, the hydrocarbyl-containing oxygenated polyamines can be used as a diesel fuel lubricity additive composition, and in methods for improving the lubricity of a diesel fuel, such as ultra-low sulfur diesel (ULSD).

The terms "comprising" and "including" and the like are intended to be open-ended and non-limiting, and therefore do not exclude other features (e.g., another component(s), or another step(s) of a method) that are not specifically recited. For example, a fuel composition that "comprises" or "includes" the hydrocarbyl group-containing oxygenated polyamine and components of a hydrotreated fractional distillation of petroleum oil (e.g., petroleum diesel, like ULSD) may have one or more other component(s) in the fuel composition, such as other additives. Examples of other optional additives include dispersants, antioxidants, viscosity index modifiers, corrosion inhibitors, and the like.

Likewise, a method for forming a lubricated fuel composition can "comprise" or "include" a step of adding the hydrocarbyl group-containing oxygenated polyamines to petroleum diesel, like ULSD, and may also include one or more other steps that a performed before, during, after, the addition of the lubricity additive. Such additional steps can include the addition of one or more other components to the fuel, or performing one or more other treatment or refining steps to the fuel.

Compositions of the disclosure can include those recited compounds and optionally can include other components in the composition but in very small amounts (e.g., described in terms of a composition "consisting essentially of" the recited components). For example, a composition that consist essentially of a hydrocarbyl group-containing oxygenated polyamine may include one or more other additional component(s), but not in an amount that is greater than about 1% (wt), greater than about 0.5% (wt), greater than about 0.1% (wt), or greater than about 0.01% (wt), of the total composition. A composition that consists essentially of the hydrocarbyl group-containing oxygenated polyamine lubricity additive that is dissolved in a solvent, aside from the polyamine and solvent, can optionally include one or more other (e.g., solid) component(s) but in an amount less than about 1% (wt) of the total composition weight. In a composition "consisting of" the recited components there is no other measurable amount of component other than the recited component.

As used herein, the terms "substantially" and "consisting essentially of" modifying, for example, the type or quantity of an ingredient in a composition, a property, a measurable quantity, a method, a position, a value, or a range, employed in describing the embodiments of the disclosure, refers to a variation that does not affect the overall recited composition, property, quantity, method, position, value, or range thereof in a manner that negates an intended composition, property, quantity, method, position, value, or range. Examples of intended properties include, solely by way of nonlimiting examples thereof, dispersibility, stability, rate, solubility, and the like; intended values include weight of a component added, concentration of components added, and the like. The effect on methods that are modified include the effects caused by variations in type or amount of materials used in a process, variability in machine settings, the effects of ambient conditions on a process, and the like wherein the manner or degree of the effect does not negate one or more intended properties or results; and like proximate considerations. Where modified by the term "substantially" or "consisting essentially of", the claims appended hereto include equivalents to these types and amounts of materials.

Optionally, compositions of the disclosure may be described as omitting certain components that are not relevant to the polyamine lubricity additive, or fuel compositions including the polyamine, such as omitting compounds that have no practical use or that provide no benefit for a fuel composition, or that would be detrimental if present in a fuel composition.

As used herein, the term "about" modifying, for example, the quantity of an ingredient in a composition, concentration, volume, process temperature, process time, yield, flow rate, pressure, and like values, and ranges thereof, employed in describing the embodiments of the disclosure, refers to variation in the numerical quantity that can occur, for example, through typical measuring and handling procedures used for making compounds, compositions, concentrates, or use formulations; through inadvertent error in these procedures; through differences in the manufacture, source, or purity of starting materials or ingredients used to carry out the methods, and like proximate considerations. The term "about" also encompasses amounts that differ due to aging of a formulation with a particular initial concentration or mixture, and amounts that differ due to mixing or processing a formulation with a particular initial concentration or mixture. Where modified by the term "about" the claims appended hereto include equivalents to these quantities. Further, where "about" is employed to describe any range of values, for example "about 1 to 5" the recitation means "1 to 5" and "about 1 to about 5" and "1 to about 5" and "about 1 to 5" unless specifically limited by context.

As used herein, the term "optional" or "optionally" means that the subsequently described object (e.g., compound), event (e.g., processing step), or circumstance may, but need not occur, and that the description includes instances where the object, event, or circumstance occurs and instances in which it does not.

The current description and appended claims may include identifiers, such as numerical, alphabetical, or alphanumeric identifiers to facilitate an understanding of claim features, such as steps within a process claim, components in a composition claim, or combinations thereof. For example, a claim may include features preceded by "(a)", "(b)", "(c)", etc., or "(i)", "(ii)", "(iii)", etc., but unless otherwise noted the alphabetical or numerical order does not imply that a particular step (e.g., "(b)") occurs after another particular step (e.g., "(a)") in the claimed process, or that a particular component in a composition (e.g., "(ii)") is present in an amount greater than another particular component (e.g., "(i)") in the claimed composition. Further, a process that "comprises" multiple steps "(a)", "(b)", "(c)", may include further steps (e.g., "(d)", "(e)", etc.) that are performed before, between, after, or any combination thereof, of any of the claimed steps. Where appropriate, a process having multiple steps may be described with the steps occurring in a particular order as dictated by the alphabetical or numerical order, or a composition having multiple components may be described with the components being present in amounts as dictated by the alphabetical or numerical order.

As used herein, the articles "a", "an" and "the" refer to one or more of the object of the article.

Described herein include hydrocarbyl-containing oxygenated polyamines that are compounds of Formula I:

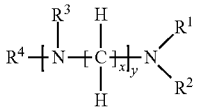

In Formula I, at least one of —$R^1$, —$R^2$, —$R^3$, and —$R^4$ includes a hydrocarbyl group and one or more oxygen atoms. The term "hydrocarbyl group" and "hydrocarbyl" are used to described carbon-containing chemical groups, as well-known to those skilled in the art. A hydrocarbyl group refers to a univalent chemical group formed by removing a hydrogen from a hydrocarbon. One or more of —$R^1$, —$R^2$, —$R^3$, and —$R^4$ can include a hydrocarbyl group that is, for example, linear, branched, or cyclic, which can be saturated, partially saturated, or fully saturated. For example, hydrocarbyl groups can include linear alkyl, branched alkyl, or cyclic alkyl, aryl, aralkyl, and the like. Hydrocarbyl groups can include aliphatic groups such as substituted or unsubstituted alkyl or alkenyl, alicyclic groups, cycloalkyl and cycloalkenyl, aromatic groups, and aliphatic-, and alicyclic-substituted aromatic groups.

Substituted hydrocarbyl groups can optionally be used. As described herein, at least one of —$R^1$, —$R^2$, —$R^3$, and —$R^4$ includes a hydrocarbyl group and one or more oxygen atoms, and the oxygen can be a part of one or more chemical group(s) that is substituted on the hydrocarbyl group, such as hydroxyl, which does not have another heteroatom. However, the hydrocarbyl groups can optionally be substituted with a group other than an oxygen-containing group like hydroxyl. If the hydrocarbyl group is substituted with a group other than an oxygen-containing group, the chemical nature of the non-oxygen substitutions (non-oxygen substituents) do not, or do not substantially, alter the hydrocarbon properties of the hydrocarbyl group. Exemplary substituents that are not hydrogen, carbon, or an oxygen-containing group include halo substituents, such as chloro and fluoro; mercapto, and alkylmercapto, as well as oxygen-containing groups that also include a non-oxygen heteroatom, like nitro, nitroso, and sulfoxy. Mixtures of different substituent groups can be used. In embodiments, a hydrocarbyl group can include three substituent groups, two substituent groups, or one substituent group. Preferably, the hydrocarbyl group has no substituent groups, or one substituent groups.

In the at least one of —$R^1$, —$R^2$, —$R^3$, and —$R^4$ that includes a hydrocarbyl group and one or more oxygen atoms, the oxygen is in the form of a hydroxyl, ether, or ester group, or more than one of these types of groups. Preferably, at least one of —$R^1$, —$R^2$, —$R^3$, and —$R^4$ includes one or more hydroxyl groups attached to one or more carbons of the hydrocarbyl group.

In the at least one of —$R^1$, —$R^2$, —$R^3$, and —$R^4$ that includes a hydrocarbyl group and one or more oxygen atoms, the oxygen atom can be separated from the most proximal nitrogen of the polyamine portion to which it is attached to by a desired number of carbon atoms. For example, in embodiments, the oxygen atom is separated from the polyamine nitrogen by one carbon, by two carbons, by three carbons, by four carbons, or by five carbons. Preferably, the oxygen atom is separated from the most proximal nitrogen of the polyamine portion by one or two carbon atoms.

Also, in Formula I, x is an integer in the range of 1-4. As such, the hydrocarbyl-containing oxygenated polyamine can be one based on a polyamine such as polyethylene amine, polypropylene amine, or polybutylene amine. A polyamine used to form the compounds of Formula I can optionally be one derived from two or more different alkyleneamines, such as a mixture of two or more of ethyleneamine, propyleneamine, and butyleneamine.

Also, in Formula I, y is an integer in the range of 1-11, 1-10 or 1-9. Accordingly, a polyamine used to form the compounds of Formula I can be derived from a compound such as diethylenetriamine, triethylenetetramine, tetraethylenepentamine, pentaethyleneamine, hexaethyleneamine, heptaethyleneamine, octaethyleneamine, nonaethyleneamine, or decaethyleneamine; dipropyleneamine, tripropyleneamine, tetrapropyleneamine, pentapropyleneamine, hexapropyleneamine, heptapropyleneamine, octapropyleneamine, nonapropyleneamine, or decapropyleneamine; or dibutyleneamine, tributyleneamine, tetrabutyleneamine, pentabutyleneamine, hexabutyleneamine, heptabutyleneamine, octabutyleneamine, nonabutyleneamine, or decabutyleneamine. Optionally, such polyamines can be referred to as "alkyleneamine oligomers.

Compositions including compounds of Formula I can be prepared using as staring materials a mixture of two or more different alkyleneamines, such as two or more alkylamines that are of different y integers (lengths), or two or more alkylamines having different chemistries (such as a mixture of polyethyleneamine and polypropyleneamine).

In Formula I, $R^5$ and $R^6$ have the same meaning as $R^1$-$R^4$. Also compounds of Formula I may have a number of carbon atoms that is three times or greater than a number of nitrogen atoms in the compound. For example, if tetraethylenepentamine ($C_8H_{23}N_5$) is used as the starting polyamine, the chemical modification to provide R groups adds at least seven (7) carbon atoms, in one or more R groups ($C=8+7 \geq N=5\times3$).

In embodiments the number of carbon atoms is four, five, six, seven, eight, nine, or ten times greater than the number of nitrogen atoms. For example, if tetraethylenepentamine ($C_8H_{23}N_5$) is used as the starting polyamine, the chemical modification to provide R groups adds at least 12, 17, 22, 27, 32, 37, or 42 carbon atoms in one or more R groups. In embodiments the number of carbon atoms is in the range of 3-10, 4-9, or 5-8 times greater than the number of nitrogen atoms in the compound.

Optionally, compounds of Formula I can be described with regards to the ratio between nitrogen atoms and carbon atoms. In embodiments, the nitrogen atom to carbon atom ratio is in the range of 1:4 to 1:30, 1:5 to 1:25, or 1:6 to 1:20.

Optionally, compounds of Formula I can be described with regards to the ratio of carbon atoms to oxygen atoms. In some embodiments, the number of carbon atoms is five, six, seven, eight, nine, or ten times or greater than a number of oxygen atoms in the compound. In some embodiments, the oxygen atom to carbon atom ratio is in the range of 1:5 to 1:25, or 1:6 to 1:20.

Optionally, compounds of Formula I can be described with regards to the ratio of nitrogen atoms to oxygen atoms. In some embodiments, the compound has a nitrogen atom to oxygen atom ratio in the range of 1:5 to 5:1, 3:10 to 10:3, or 1:4 to 4:1.

Optionally, compounds of Formula I can be described with regards to their molecular weight. In some embodiments, compounds of Formula I have a molecular weight of at least about 100 Da, of at least about 150 Da, of at least about 200 Da, of at least about 250 Da, or of at least about 400 Da, such as in the range of about 100 Da to 2000 Da, about 150 Da to about 1800 Da, about 200 Da to about 1600 Da, or about 250 Da to about 1500 Da.

As noted herein, in Formula I, at least one of —$R^1$, —$R^2$, —$R^3$, and —$R^4$ includes a hydrocarbyl group and one or more oxygen atoms. In embodiments, two, three, four, or five of $R^1$-$R^4$ are the carbon- and oxygen-containing groups. If the compound of Formula I includes two or more of —$R^1$, —$R^2$, —$R^3$, and —$R^4$ being carbon- and oxygen-containing groups, then these two or more groups can be the same, or these two or more can be different. If two or more of —$R^1$, —$R^2$, —$R^3$, and —$R^4$, are different, then the difference can be with regards to the carbon content, the chemical structure, or the oxygen content in these groups.

As noted herein, in Formula I, at least one of —$R^1$, —$R^2$, —$R^3$, and —$R^4$ includes a hydrocarbyl group and one or more oxygen atoms, and in embodiments an amount of carbon atoms in the range of 6-30, 8-24, 10-22, or 12-20.

In embodiments, any one or more of $R^1$-$R^4$ has the Formula —$(CR^7{}_2)_q(CHOH)R^8$, wherein $R^7$ is independently selected from —H and alkyl, wherein q is 0 (a covalent bond), or an integer in the range of 1-4, and $R^8$ is selected from the group consisting of C6-C28 saturated, partially saturated, or unsaturated, linear, branched, or cyclic alkyl, aryl, alkyl-aryl, and aryl-alkyl, optionally substituted with a group including a non-oxygen atom. In some more specific embodiments, $R^7$ is —H; q is 2; and $R^8$ is selected from the group consisting of C10-C22 linear, branched, cyclic alkyl, aryl, alkyl-aryl, and aryl-alkyl.

In embodiments, one or more of —$R^1$, —$R^2$, —$R^3$, and —$R^4$ are selected from:

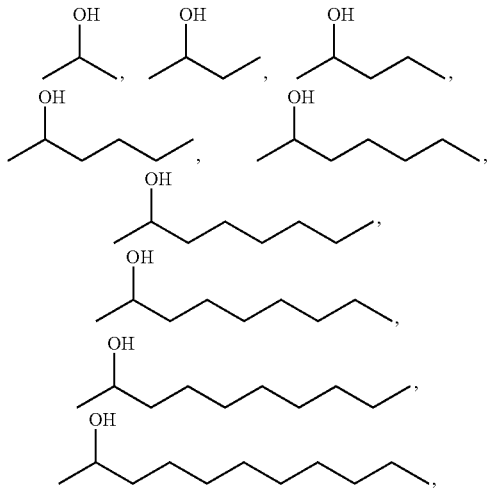

-continued

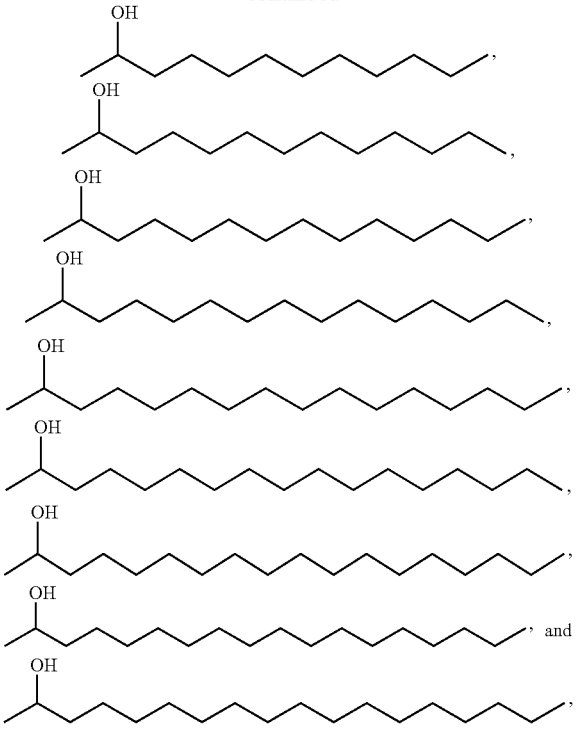

In other embodiments any one or more of $R^1$-$R^4$ has the Formula —$(CR^9{}_2)_q(CHOH)(R^{10}O)R^{11}$, wherein $R^9$ is independently selected from —H and alkyl, q is 0 (a covalent bond) or an integer in the range of 1-4, preferably, 1 or 2, $R^{10}$ is $(CH_2)_w$—, wherein w is 1, 2, or 3, and $R^{11}$ is selected from the group consisting of C6-C28 saturated, partially saturated, or unsaturated, linear, branched, or cyclic alkyl, aryl, alkyl-aryl, and aryl-alkyl, optionally substituted with a group including a non-oxygen atom. In some more specific embodiments, $R^9$ is —H; q is 2; w is 1, and $R^{11}$ is selected from the group consisting of C10-C22 linear, branched, or cyclic alkyl, aryl, alkyl-aryl, and aryl-alkyl.

In embodiments, one or more of —$R^1$, —$R^2$, —$R^3$, and —$R^4$ are selected from:

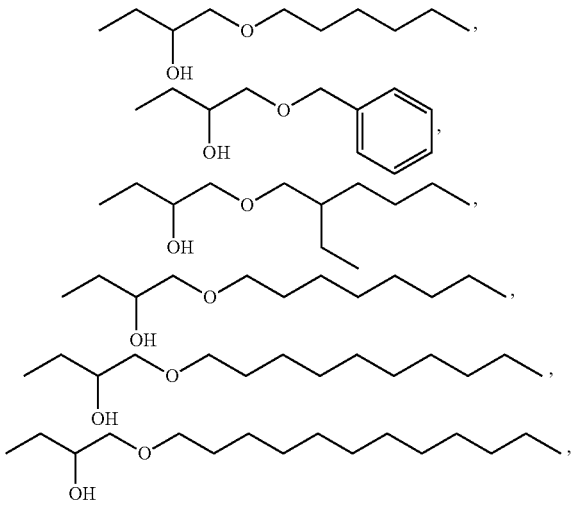

-continued

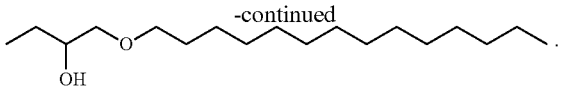

For compounds of Formula I, in embodiments, any one or more of the $R^1$-$R^4$ group(s) that are not groups having the hydrocarbyl group and one or more oxygen atoms, or —$(CH_2)_xNR^5R^6$, can be —H.

Formula I also encompasses hydrocarbyl-containing oxygenated polyamines of Formula II, which are based on a polyethyleneamine, as follows:

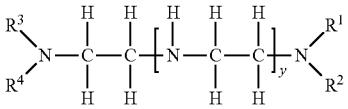

In Formula II, $R^1$-$R^4$ are independently selected from —H, —OH, alkyl, aryl, alkyl aryl, and aryl alkyl, and the hydrocarbyl- and oxygen-containing group, wherein y is an integer in the range of 1-10, and wherein at least one of $R^1$-$R^4$ is the hydrocarbyl- and oxygen-containing group. In more specific aspects of Formula II, the integer y and the $R^1$-$R^4$ groups as described with reference to Formula I herein can be applied to Formula II.

In some embodiments the disclosure provides a composition comprising a mixture of two or more compounds of Formula I or Formula II. For example, a composition can include a mixture of two or more hydrocarbyl-containing oxygenated polyamines which are different based on at least the number of nitrogen atoms in the compounds. For example, the hydrocarbyl-containing oxygenated polyamines can be prepared from a starting composition with a mixture of polyamines of different lengths, such as a mixture of polyamines having two of more polyamines that have 5, 6, 7, 8, or 9 nitrogen atoms.

For example, a composition such as ETHYLENEAMINE E-100™ (Huntsman) which is a mixture of tetraethylenepentamine (TEPA), pentaethylenehexamine (PEHA), hexaethyleneheptamine (HEHA), and higher molecular weight products, and includes various linear, cyclic, and branched products with a number-average molecular weight of 250-300 g/mole, can be used to prepare hydrocarbyl-containing oxygenated polyamines of the disclosure. The resulting product will include a mixture of compounds with different polyamine lengths and therefore different molecular weights.

Beneficially, hydrocarbyl-containing oxygenated polyamines of the disclosure show a low acid value (acid number). Low acid values are desirable in a fuel composition such as diesel because it reduces the likelihood of additive breakdown, and therefore fuel Formulations with additives, including those lubricity additives of the disclosure, can maintain desirable properties over longer periods of storage. In embodiments, hydrocarbyl-containing oxygenated polyamines of the disclosure have an acid value of less than about 1.5, less than about 1.25, less than about 1, or less than about 0.75. Exemplary acid values are in the range of about 0.25 to about 1.5, about 0.4 to about 1.4, or about 0.5 to about 1.25.

In other aspects, the disclosure provides a method for making a hydrocarbyl-containing oxygenated polyamine fuel lubricity additive. As a general matter, the method involves reactive a polyamine, or polyamine derivative, with an epoxide-containing compound that includes a hydrocarbyl group. For example, in one mode of practice, the method includes a step of reacting a polyamine of Formula III:

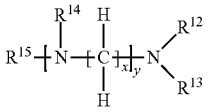

wherein —$R^{12}$, —$R^{13}$, —$R^{14}$, and —$R^{15}$, are independently selected from —H, —OH, alkyl, aryl, alkyl aryl, and aryl alkyl, optionally including substitution, wherein at least one of $R^{12}$-$R^{15}$ is —H, wherein x is an integer in the range of 1-4, wherein y is an integer in the range of 1-10 or 1-9, with an epoxide-containing compound that includes a hydrocarbyl group to provide the hydrocarbyl-containing oxygenated polyamine product. The hydrocarbyl group can have a number of carbons in the range of 6-30, 8-24, 10-22, or 12-20. In aspects, the epoxide-containing compound has a single epoxide group or the epoxide-containing compound is a glycidyl ether compound.

Polyamine reactants include linear or branched polyethyleneamine, polypropyleneamine, and polybutyleneamine, including polyamines species such as ethylenediamine (EDA), diethylenetriamine (DETA), triethylenetetramine (TETA), tetraethylenepentamine (TEPA), pentaethylenehexamine (PEHA), propylenediamine, dipropylenetriamine, tripropylenetetramine, N-3-aminopropyl ethylenediamine (Am3), N,N'-bis(3-aminopropyl)ethylenediamine (Am4), N,N,N'-tris(3-aminopropyl)ethylene-diamine (Am5); N-3-aminopropyl-1,3-diaminopropane, N,N'-bis(3-aminopropyl)-1,3-diaminopropane, N,N,N'-tris(3-aminopropyl)-1,3-diaminopropane, putrescine (butane-1,4-diamine), cadaverine (Pentane-1,5-diamine), spermidine ($N^1$-(3-Aminopropyl)butane-1,4-diamine), spermine (N,N'-bis(3-aminopropyl)butane-1,4-diamine), thermospermine (N'-[3-(3-aminopropylamino)propyl]butane-1,4-diamine), caldopentamine (N'-[3-[3-(3-aminopropylamino)propylamino]propyl]propane-1,3-diamine), and caldohexamine (N'-[3-[3-[3-(3-aminopropylamino)propylamino]propylamino]propyl]propane-1,3-diamine), tris(3-aminopropyl) amine.

Epoxide-containing reactants include oxirane- and oxitane-containing reactants, such as those according to Formula IV:

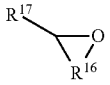

wherein $R^{16}$ is —$(CH_2)$— or —$(CH_2CH_2)$—, wherein $R^{17}$ is a hydrocarbyl group. In embodiments $R^{17}$ is a linear or branched alkyl group of having a number of carbons in the range of 6-28, 8-24, or 10-22. Exemplary reactive compounds are 1,2-epoxyalkanes such as the species of 1,2-epoxyhexane, 1,2-epoxyheptane, 1,2-epoxyoctane, 1,2-epoxydecane, 1,2-epoxydodecane, 1,2-epoxytetradecane, 1,2-epoxyhexadecane, and 1,2-epoxyoctadecane.

In some modes of practice, the oxirane-containing reactant is of Formula V:

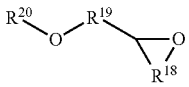

wherein $R^{18}$ is —$(CH_2)$— or —$(CH_2CH_2)$—, wherein $R^{19}$ is —$(CH_2)_w$—, wherein w is an integer in the range of 1-3, and wherein $R^{20}$ is a linear or branched alkyl group of having a number of carbons in the range of 6-24, 8-22, or 10-20. Exemplary reactive compounds are C8-C10 alkyl glycidyl ethers and C12-C14 alkyl glycidyl ethers.

In some cases, the polyamine reactant includes hydrogen atoms on all of the —$R^{12}$-$R^{15}$ groups. These active hydrogen groups are reactive with the epoxide group of the hydrocarbyl-containing reactant. A total number of active hydrogens can be determined on the polyamine reactant. Next, a molar ratio of the epoxide- and hydrocarbyl-containing reactant to the polyamine reactant can be chosen to provide a desired number of —$R^{12}$-$R^{15}$ groups that become derivatized to form a compound of Formula I that includes R groups containing oxygen, such as in the form of a hydroxyl group, and the hydrocarbyl group.

In some embodiments, the reaction uses a molar ratio of about 1:1 polyamine reactant to epoxide- and hydrocarbyl-containing reactant, to provide a hydrocarbyl-containing oxygenated polyamines product with a single R group. In some embodiments, the reaction uses a molar ratio of about 1:2, uses a molar ratio of about 1:3, uses a molar ratio of about 1:4, or uses a molar ratio of about 1:5 polyamine reactant to epoxide- and hydrocarbyl-containing reactant, to provide a hydrocarbyl-containing oxygenated polyamines product with two, three, four, or five R groups, respectively. In embodiments of the below formula wherein k is 10, the maximum number of substituted R groups can be 14, meaning up to a 1:14 ratio of polyamine reactant to epoxide- and hydrocarbyl-containing reactant can be used for forming compounds of the disclosure (e.g., in Formula I herein $R^3$ can be repeated up to 11 times, and therefore up to 14 of groups $R^1$-$R^4$ can be carbon- and oxygen-containing groups, such as described herein).

An exemplary reaction scheme (Scheme 1) is shown below:

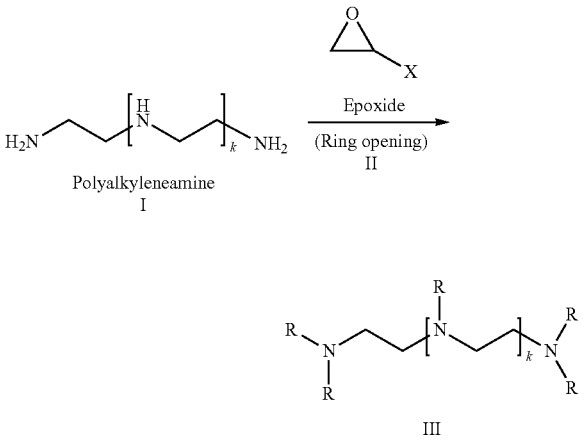

Wherein

R=H and/or

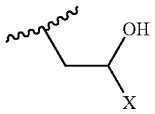

k=Integer of 1-10

X is —$(CH_2O)_n$—R1, n=0, 1

R1 is linear or branched C8-C30 alkylene group

Exemplary compounds can be formed having the structures as shown in Table 1 below:

TABLE 1

| Structure |
|---|
| 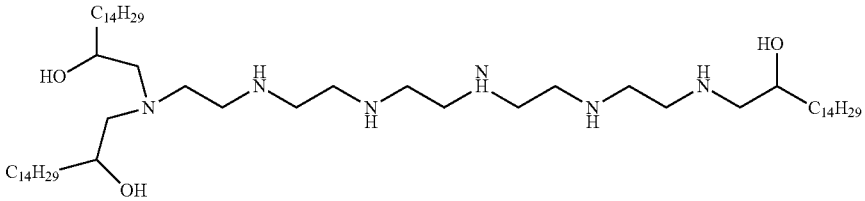 |
| 1,2-Epoxyhexadecane-PEHA (1:3 adduct) |
| 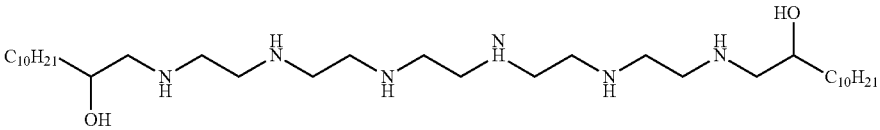 |
| 1,2-Epoxydodecane-PEHA (1:2 adduct) |
| 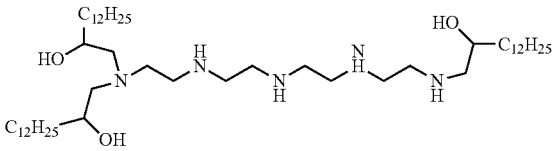 |
| 1,2-Epoxytetradecane-TEPA (1:3 adduct) |
| 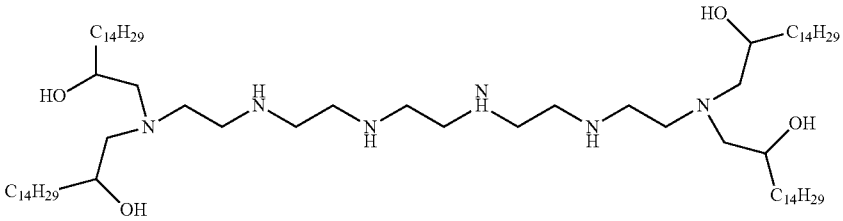 |
| 1,2-Epoxyhexadecane-PEHA (1:4 adduct) |

As shown, for many hydrocarbyl-containing oxygenated polyamine products formed only a portion of the active hydrogens of the polyamine are replaced by R groups. Generally, about 7.5% or greater, 10% or greater, 12.5% or greater, 15% or greater, 17.5% or greater, 20% or greater, 22.5% or greater, or 25% or greater of the active hydrogens are replaced by R groups, and generally less than 75%, less than 65%, less than 55%, and less than 50% of the active hydrogens are replaced by R groups, or an amount of active hydrogens are replaced in a range according to any of the % values herein described (e.g., 7.5%-75%, 7.5%-65%, 7.5%-55%, 10%-75%, 10%-65%, 10%-55%, etc.).

In some cases, the polyamine reactant includes an alkyl, aryl, alkyl aryl, and aryl alkyl group, optionally substituted, on one or more, but not all of —$R^{12}$-$R^{15}$. For these types of polyamine reactants, there is at least one alkyl, etc., group and at least one active hydrogen, and preferably multiple active hydrogens, or more active hydrogens than alkyl, etc, groups. Exemplary reactants of this type include alkylated polyamines such as described in US2009/0029175, which are formed by reacting a polyamine reactant, such as described herein, with an C1-C10 alkylated aldehyde or ketone, or an alkyl halide.

Reaction can be carried out for a time and temperature sufficient to prepare the hydrocarbyl-containing oxygenated polyamine product. For example, reaction times and temperatures and times may be in the range of about 100° C. to about 160° C., or about 120° C. to about 140° C., and for about 1 to 6 hours, or for about 2 to 4 hours.

Reactions can be carried out either in bulk (no solvent, i.e., "neat") or in a suitable solvent, such as heavy aromatic naphtha (HAN). Other types of solvents such as low molecular weight organic liquids like halogenated organic solvents, such as methylchloroform, 1,1,2-trichloro-1,2,2-trifluoroethane, trichloroethylene, and trifluorotoluene; aromatic solvents, such as benzene, toluene, and xylene; aliphatic and alicyclic hydrocarbons, such as hexane, heptane, and cyclohexane; ethers, such as diethyl ether, diisopropyl ether, and tetrahydrofuran; esters, such as ethyl acetate and butyl acetate; alcohols, such as ethanol and isopropyl alcohol; ketones, such as acetone, methyl ethyl ketone, and methyl isobutyl ketone; sulfoxides, such as dimethyl sulfoxide; amides, such as N,N-dimethylformamide, N,N-dimethylacetamide, and N-methyl-2-pyrrolidone, can be used.

The hydrocarbyl-containing oxygenated polyamines can be in form of a stock or concentrate composition for addition to a fuel composition, such as USDL. The stock composition can be in neat form with essentially no, or no measureable other component (e.g., no solvent). Alternatively, the polyamine product can be in the form of a concentrate, such as where the hydrocarbyl-containing oxygenated polyamine is the predominant (i.e., >50% by weight) component in the stock composition, with the other component(s) being a solvent or solvent mixture compatible with the hydrocarbyl-containing oxygenated polyamine. Accordingly, the disclosure also provides a lubricity additive composition including the compound of Formula I, or a compound prepared according to the method of as described herein, and a fuel-compatible diluent.

If the hydrocarbyl-containing oxygenated polyamine is in a gel or solid form at room temperature in the absence of solvent, typically a solvent will be added to solubilize the compound. Small volumes of solvent may be used in these cases, such as less than 25%, less than 20%, less than 15%, or less than 10% by weight, and wherein the concentrate is stable during prolonged storage at temperatures below room temperature.

In addition to the hydrocarbyl-containing oxygenated polyamine, compositions of the disclosure (e.g., stock compositions, diluted compositions, fuel compositions, such as diesel fuel) may optionally include one or more additional components. Such optional additional compounds can include corrosion inhibitors, solvents, de-emulsifiers, amine stabilizers, dispersants, antioxidants, combustion improvers, cold flow improvers, pour point depressants, heat stabilizers, cetane improvers, conductivity improvers, metal deactivators, marker dyes, organic nitrate ignition accelerators, and other components useful for fuel compositions. In addition to the hydrocarbyl-containing oxygenated polyamine lubricity improver, the other optional additive(s) can be present in the fuel composition in amounts sufficient to provide effective additive properties.

In some embodiments, the hydrocarbyl-containing oxygenated polyamine lubricity enhancer is added to a petroleum product that is or derived from a crude oil, a reduced crude oil, a heavy oil, a bitumen, a coker charge, a hydrotreater influent, a hydrotreater effluent, a flashed crude, a light cycle oil, or a diesel or naphtha refinery stream. The hydrocarbyl-containing oxygenated polyamine lubricity enhancer can be added to naphtha products, such as diesel fuel, more specifically described herein. A diesel fuel Formulation can be one that has particular specifications and that complies with diesel fuel standards, such as for example EN 590 (Europe) or ASTM D975 (USA).

The hydrocarbyl-containing oxygenated polyamine lubricity enhancer can be present in a fuel composition in an amount suitable to provide lubricity to the fuel composition. For example, the polyamine can be present at a concentration of 30 ppm (parts per million by weight) or greater, 50 ppm or greater, 75 ppm or greater, 100 ppm or greater, 125 ppm or greater, or 150 ppm or greater. The polyamine can be present at a concentration of up to 1000 ppm, up to 900 ppm, up to 800 ppm, up to 700 ppm, up to 600 ppm, up to 500 ppm, up to 400 ppm, or up to 300 ppm. The polyamine can be present in an amount of in a range according to any of the ppm values herein described (e.g., 50 ppm to 1000 ppm, 50 ppm to 800 ppm, 50 ppm to 500 ppm, 75 ppm to 1000 ppm, 75 ppm to 800 ppm, 75 ppm to 500 ppm, etc.).

An additives composition including the hydrocarbyl-containing oxygenated polyamine lubricity enhancer described herein, and optional components used in Formulating the fuels, can be blended into a base diesel fuel individually, or in various sub-combinations. In some embodiments, additive components including the hydrocarbyl-containing oxygenated polyamine lubricity enhancer can be blended into the diesel fuel using a package composition, wherein the components therein are mutually compatible, and therefore provide a convenient way of including additives to the fuel. In some embodiments, the additive is prepared, packaged, and sold separately from diesel fuel, such as would be the case for when the additive is in a concentrated form. An additive composition, e.g., a concentrate including the hydrocarbyl-containing oxygenated polyamine lubricity enhancer, can be blended into the diesel fuel by a user. In other cases, the additive composition can be added to diesel fuel at a terminal location, such as where large quantities of fuel from a pipeline distribution system are stored.

In embodiments, the hydrocarbyl-containing oxygenated polyamines can be used in a wide variety of diesel fuel applications. For example, the polyamine lubricants of the disclosure can be used for diesel fuels for vehicles such as automobiles, trucks, construction equipment, military vehicles and equipment, aircraft including planes and helicopters, etc. (e.g., ambulatory diesel engines). The polyamine lubricants of the disclosure can also be used for stationary diesel engines, such as those used in pumping stations and engines for electrical power generation installations.

Lubricity is a measure of a substance's ability to reduce the friction and wear between surfaces which are in relative motion. The lubricity of a fuel formulation can be assessed by any suitable method, such as one that allows assessment of wear scar produced on an oscillating ball from contact with a stationary plate while immersed in the formulation that includes the lubricity enhancer to be tested. More specifically, the ability of a compound to provide lubricity to a fuel composition can be measured by wear scar diameter (WSD) analysis, using standard test method, such as ASTM D 6079, or the standard test method ISO 12156 measuring HFRR (high friction reciprocating rig) wear scar. In such tests measuring the extent of wearing, the test substance undergoes wearing because of friction. WSD is thus a measure of the fluid lubricity, and the lower the WSD value, the better lubricity the compound provides. The formulation may have a lubricity such that it gives a HFRR (high friction reciprocating rig) wear scar result, according to the standard test method ISO 12156, of 550 um or less, preferably 500 um or less, or more preferably 460 um or less.

Improved or enhanced lubricity of a formulation with the hydrocarbyl-containing oxygenated polyamine lubricity enhancer may be understood by a lower degree of wear scar, or of other friction-induced damage, in two relatively-moving components which are exposed to the compound. The inventive hydrocarbyl-containing oxygenated polyamines of the disclosure may be used to achieve any degree of improvement in the lubricity of a fuel formulation, and/or for the purpose of achieving a desired target lubricity, for example a target set by an applicable current standard such as EN 590. With regards to lubricity and reducing wear, the hydrocarbyl-containing oxygenated polyamine can show an improvement as expressed by a certain percentage of improvement as calculated by subtracting the wear number from a composition with hydrocarbyl-containing oxygenated polyamine from the wear number from a composition with no lubricity enhancer, and then dividing the result by the wear number from a composition with no enhancer (e.g., 558−408=150, 150/558=26.9% improvement in lubricity). In embodiments, addition of the hydrocarbyl-containing oxygenated polyamines provides an improvement in lubricity of greater than 5%, greater than 10%, greater than 15%, greater than 20%, greater than 25%, or greater than 30%, such as up to 35%, for example in the range of 5%-35%, or 10%-35%, as compared to a composition with no lubricity enhancer.

Unless otherwise noted, all reagents were obtained or are available from Aldrich Chemical Co., Milwaukee, WI, (Aldrich) or may be synthesized by known methods. All parts, percentages, ratios, etc. in the examples and the rest of the specification are by weight, unless noted otherwise. The terms "weight %", "% by weight", and "wt %" are used interchangeably.

Various modifications and alterations of this disclosure will become apparent to those skilled in the art without departing from the scope and principles of this disclosure, and it should be understood that this disclosure is not to be unduly limited to the illustrative embodiments set forth hereinabove. Objects and advantages of this disclosure are further illustrated by the following examples, but the particular materials and amounts thereof recited in these examples, as well as other conditions and details, should not be construed to unduly limit this disclosure.

EXAMPLES

Polyamine-hydrophobic epoxide adducts were synthesized as lubricity improvers for ULSD. The generic synthesis reaction for preparation of such amine-epoxide adduct chemistries is shown in Scheme 1.

The amine-epoxide adducts (III) were conveniently prepared by reacting a polyamine (I) with a hydrophobic epoxide (II) at 120-140° C. for 2-4 h. Reactions were carried out either in bulk (no solvent) or heavy aromatic naphtha (HAN) as solvent.

Lubricity Performance Data (HFRR: High Frequency Reciprocating Rig, ISO 12156, ASTM D6079): The results are given in the Table 2 below. The data show that some of the amine-epoxide adduct chemistries show at least equivalent or better performance compared to the incumbent chemistry (EC5725A, wear scar=397 um).

TABLE 2

| S. No | Sample ID | Amine | Epoxide | Amine:Epoxide | Wear Scar (um) |
|---|---|---|---|---|---|
| | 8606-24 | Diethylenetriamine | 1,2-Epoxyhexadecane | 1:3 moles | 413 |
| 1. | 8275-80 | Diethylenetriamine | C8-C10 alkyl glycidyl ether | 1:5 moles | 390 |
| 2. | 8606-02 | Diethylenetriamine | C12-C14 alkyl glycidyl ether | 1:3 moles | 408 |
| | 8606-33 | Tetraethylenepentamine | 1,2-Epoxytetradecane | 1:3 moles | 440 |
| | 8606-34 | Tetraethylenepentamine | 1,2-Epoxytetradecane | 1:4 moles | 418 |
| 3. | 8606-41 | Tetraethylenepentamine | 1,2-Epoxyhexadecane | 1:3 moles | 401 |
| | 8606-40 | Tetraethylenepentamine | 1,2-Epoxyhexadecane | 1:4 moles | 442 |
| 4. | 8606-99 | Tetraethylenepentamine | C12-C14 alkyl glycidyl ether | 1:4 moles | 514 |
| 5. | 8606-100 | Tetraethylenepentamine | C12-C14 alkyl glycidyl ether | 1:5 moles | 457 |
| 6. | 8511-35 | Ethyleneamine E-100 | C12-C14 alkyl glycidyl ether | 1:1 mole | 490 |
| 7. | 8511-42 | Pentaethylenehexamine | C12-C14 alkyl glycidyl ether | 1:1 mole | 524 |
| 8. | 8511-41 | Pentaethylenehexamine | C12-C14 alkyl glycidyl ether | 1:2 moles | 530 |
| 9. | 8511-94 | Pentaethylenehexamine | C12-C14 alkyl glycidyl ether | 1:3 moles | 414 |
| 10. | 8511-95 | Pentaethylenehexamine | C12-C14 alkyl glycidyl ether | 1:4 moles | 401 |
| 11. | 8606-22 | Pentaethylenehexamine | 1,2-Epoxydodecane | 1:2 moles | 414 |
| 12. | 8606-42 | Pentaethylenehexamine | 1,2-Epoxytetradecane | 1:2 moles | 389 |
| | 8606-46 | Pentaethylenehexamine | 1,2-Epoxyhexadecane | 1:2 moles | 417 |
| | 8606-47 | Pentaethylenehexamine | 1,2-Epoxyhexadecane | 1:3 moles | 370 |
| 13. | 8606-48 | Pentaethylenehexamine | 1,2-Epoxyhexadecane | 1:4 moles | 415 |
| 14. | EC5725A | — | — | — | 397 |
| | Blank | — | — | — | 558 |

Acid Number Data (Selected): The results are given in the Table 3 below. The data show that amine-epoxide adduct chemistries show low acid number values.

TABLE 3

| S. No | Sample ID | Amine | Epoxide | Amine:Epoxide | Acid Number (mg KOH/g) |
|---|---|---|---|---|---|
| 1. | 8275-80 | Diethylenetriamine | C8-C10 alkyl glycidyl ether | 1:5 moles | 1.30 |
| 2 | 8511-42 | Pentaethylenehexamine | C12-C14 alkyl glycidyl ether | 1:1 mole | 0.67 |
| 3. | 8511-41 | Pentaethylenehexamine | C12-C14 alkyl glycidyl ether | 1:2 moles | 0.64 |
| 4. | 8511-95 | Pentaethylenehexamine | C12-C14 alkyl glycidyl ether | 1:4 moles | 0.59 |
| 5. | 8606-22 | Pentaethylenehexamine | 1,2-Epoxydodecane | 1:2 moles | 1.20 |

What is claimed is:

1. A method for improving the lubricity of a fuel composition comprising:

adding a composition comprising a compound of Formula I:

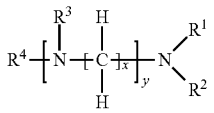

to a fuel composition, wherein —$R^1$, —$R^2$, —$R^3$, and —$R^4$, are independently selected from—H, —OH, alkyl, aryl, alkyl aryl, and aryl alkyl, optionally substituted, —$(CH_2)_xNR^5R^6$, and a carbon- and oxygen-containing group including one or more oxygen atoms in the form of (i) a hydroxyl group, (ii) an ether group, (iii) an ester group, or more than one of (i)-(iii), wherein at least one of $R^1$-$R^4$ is the carbon- and oxygen-containing group, and the carbon- and oxygen-containing group has a C6-C30 linear, branched, cyclic alkyl, aryl, alkyl-aryl, or aryl-alkyl terminal portion, wherein x is an integer in the range of 1-4, wherein y is an integer in the range of 1-11, and wherein $R^5$ and $R^6$ have the same meaning as any one of $R^1$-$R^4$, optionally wherein the compound has a number of carbon atoms that is three times or greater than a number of nitrogen atoms in the compound, wherein the compound improves lubricity of the fuel composition.

2. The method of claim 1, wherein the number of carbon atoms is three times greater than the number of nitrogen atoms, or the nitrogen atom to carbon atom ratio is in the range of 1:4 to 1:30.

3. The method of claim 2, wherein the number of carbon atoms is four, five, six, seven, eight, nine, or ten times of greater than a number of oxygen atoms in the compound, or the oxygen atom to carbon atom ratio is in the range of 1:5 to 1:25.

4. The method of claim 1, wherein the compound has a number of nitrogen atoms in the range of 3-12, and a nitrogen atom to oxygen atom ratio in the range of 1:5 to 5:1.

5. The method of claim 1, wherein the compound has a molecular weight in the range of about 100 Da to about 2000 Da.

6. The method of claim 1 wherein the $R^1$-$R^4$ group(s) that are not either the carbon- and oxygen-containing group(s) or —$(CH_2)_xNR^5R^6$ are —H.

7. The method of claim 1 wherein the compound is of Formula II:

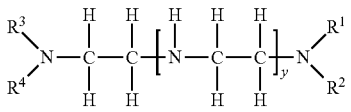

wherein $R^1$-$R^4$ are independently selected from—H, —OH, alkyl, aryl, alkyl aryl, and aryl alkyl, and the carbon- and oxygen-containing group, wherein y is an integer in the range of 1-8, and wherein at least one of $R^1$-$R^4$ is the carbon- and oxygen-containing group.

8. The method of claim 1 wherein two, three, or four of $R^1$-$R^4$ are the carbon- and oxygen-containing groups.

9. The method of claim 8, wherein the carbon- and oxygen-containing groups are different based on (i) number of carbons, (ii) number of oxygens, or both (i) and (ii).

10. The method of claim 1 wherein the carbon- and oxygen-containing group(s) has an amount of carbon atoms in the range of 6-30.

11. The method of claim 1 wherein any of $R^1$-$R^4$ has the Formula-$(CR^7{}_2)_q(CHOH)R^8$, wherein $R^7$ is independently selected from —H and alkyl, wherein q is 0 (a covalent bond), or an integer in the range of 1-4, and $R^8$ is selected from the group consisting of C6-C28 linear, branched, cyclic alkyl, aryl, alkyl-aryl, and aryl-alkyl.

12. The method of claim 11, wherein $R^7$ is —H; q is 2; and $R^8$ is selected from the group consisting of C10-C22 linear, branched, cyclic alkyl, aryl, alkyl-aryl, and aryl-alkyl.

13. The method of claim 1 wherein any of $R^1$-$R^4$ has the Formula —$(CR^9{}_2)_q(CHOH)(R^{10}O)R^{11}$, wherein $R^9$ is independently selected from —H and alkyl, q is 0 (a covalent bond) or an integer in the range of 1-4, preferably, 1 or 2, $R^{10}$ is $(CH_2)_w$—, wherein w is 1, 2, or 3, and $R^{11}$ is selected from the group consisting of C6-C28 linear, branched, cyclic alkyl, aryl, alkyl-aryl, and aryl-alkyl, optionally wherein $R^9$ is —H; q is 2; w is 1, and $R^{11}$ is selected from the group consisting of C10-C22 linear, branched, or cyclic alkyl, aryl, alkyl-aryl, and aryl-alkyl.

14. The method of claim 1, wherein the compound of Formula I has an acid value of less than about 1.5.

15. The method of claim 1 wherein the composition comprises a mixture of two or more different compounds of Formula I, wherein the compounds are different based on at least the number of nitrogen atoms in the compounds.

16. The method of claim 1, wherein the compound of Formula I is added to the fuel composition at a concentration in the range of about 30 ppm to about 1000 ppm.

17. The method of claim 1, wherein the fuel composition comprises diesel fuel.

18. A fuel composition comprising a compound of Formula I:

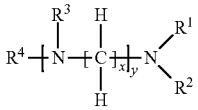

wherein —$R^1$, —$R^2$, and —$R^3$ are independently selected from —H, —OH, alkyl, aryl, alkyl aryl, and aryl alkyl, optionally substituted, —$(CH_2)_xNR^5R^6$, and a carbon- and oxygen-containing group including one or more oxygen atoms in the form of (i) a hydroxyl group, (ii) an ether group, (iii) an ester group, or more than one of (i)-(iii), and the carbon- and oxygen-containing group has a C6-C30 linear, branched, cyclic alkyl, aryl, alkyl-aryl, or aryl-alkyl terminal portion, wherein at least one of $R^1$-$R^4$ is the carbon- and oxygen-containing group, and wherein —$R^4$ is —$(CH_2)_xNR^5R^6$, wherein x is an integer in the range of 1-4, wherein y is an integer in the range of 1-11, and wherein $R^5$ and $R^6$ have the same meaning as any one of $R^1$-$R^4$, optionally wherein the compound has a number of carbon atoms that is three times or greater than a number of nitrogen atoms in the compound.

19. A method for making an oxygenated polyamine fuel lubricity additive comprising:

reacting a polyamine of Formula III:

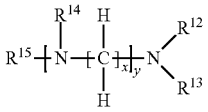

wherein —$R^{12}$, —$R^{13}$, —$R^{14}$, and —$R^{15}$, are independently selected from —H, —OH, alkyl, aryl, alkyl aryl, and aryl alkyl, optionally substituted, wherein at least one of $R^{12}$-$R^{15}$ is —H, wherein x is an integer in the range of 1-4, wherein y is an integer in the range of 1-11, with an epoxide-containing compound having a number of carbons in the range of 6-30, to provide the oxygenated polyamine, optionally wherein the polyamine and the epoxide-containing compound are present in a molar ratio in the range of 1:1 to 1:6, optionally wherein the epoxide-containing compound has a single epoxide group or the epoxide-containing compound is a glycidyl ether compound, optionally wherein the epoxide-containing compound is of Formula IV:

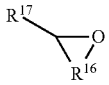

wherein $R^{16}$ is —$(CH_2)$— or —$(CH_2CH_2)$—, wherein $R^{17}$ is a hydrocarbyl group, wherein $R^{17}$ optionally has a number of carbons in the range of 6-28, optionally wherein the epoxide-containing compound is of Formula V:

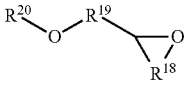

wherein $R^{18}$ is —$(CH_2)$— or —$(CH_2CH_2)$—, wherein $R^{19}$ is —$(CH_2)_w$—, wherein w is an integer in the range of 1-3, optionally wherein $R^{20}$ is a linear or branched alkyl group of having a number of carbons in the range of 6-24.

20. A lubricity additive composition comprising the compound of Formula I of claim 1.

* * * * *